US006341437B1

(12) United States Patent
Heiling et al.

(10) Patent No.: US 6,341,437 B1
(45) Date of Patent: Jan. 29, 2002

(54) MEMORIAL STAND

(76) Inventors: Joyce L. Heiling; Daniel G. Heiling, both of 2053 139TH La. Northwest, Andover, MN (US) 55304

( * ) Notice: Subject to any disclaimer, the term of this patent is extended or adjusted under 35 U.S.C. 154(b) by 0 days.

(21) Appl. No.: 09/267,019

(22) Filed: Mar. 11, 1999

(51) Int. Cl.[7] ..... E04H 13/00; G09F 19/00
(52) U.S. Cl. ..... 40/124.5; 52/103
(58) Field of Search ..... 40/124.5, 312, 40/313, 607, 655, 712; 248/460, 463, 156; 52/103; 206/232, 459.5

(56) References Cited

U.S. PATENT DOCUMENTS 359,639 A * 3/1887 Shelton ..... 40/124.5
373,243 A * 11/1887 Miller ..... 40/124.5
1,272,817 A * 7/1918 Lewis ..... 40/124.5
1,573,268 A * 2/1926 Norman ..... 40/124.5
2,070,940 A * 2/1937 Duchan ..... 248/460
2,153,229 A * 4/1939 Arkin ..... 40/124.5
4,674,303 A * 6/1987 Salcone, II ..... 70/162
4,756,108 A * 7/1988 Lackey et al. ..... 40/611
5,553,426 A * 9/1996 Ostergaard ..... 40/124.5
5,850,796 A * 12/1998 Cislo ..... 70/162

* cited by examiner

*Primary Examiner*—Cassandra H. Davis

(57) ABSTRACT

A memorial assembly is provided including a post, an encasement mounted on the post with a compartment therein, and a photograph mount situated in the compartment of the encasement for holding a photograph therein.

4 Claims, 2 Drawing Sheets

10
16
20
22
IN
LOVING
MEMORY
18
12

20
34
16
26
18
12

MEMORIAL STAND

BACKGROUND OF THE INVENTION

1. Field of the Invention

The present invention relates to sign holders and markers and more particularly pertains to a new memorial stand for storing and showcasing photographs and memorabilia at a grave.

2. Description of the Prior Art

The use of sign holders and markers is known in the prior art. More specifically, sign holders and markers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,276,798; U.S. Pat. No. 3,058,246; U.S. Pat. Des. 386,880; U.S. Pat. No. 4,173,086; U.S. Pat. No. 5,044,200; and U.S. Pat. No. 1,573,268.

In these respects, the memorial stand according to the present invention substantially departs from the conventional concepts and designs of the prior art, and in so doing provides an apparatus primarily developed for the purpose of storing and showcasing photographs and memorabilia at a grave.

SUMMARY OF THE INVENTION

In view of the foregoing disadvantages inherent in the known types of sign holders and markers now present in the prior art, the present invention provides a new memorial stand construction wherein the same can be utilized for storing and showcasing photographs and memorabilia at a grave.

The general purpose of the present invention, which will be described subsequently in greater detail, is to provide a new memorial stand apparatus and method which has many of the advantages of the sign holders and markers mentioned heretofore and many novel features that result in a new memorial stand which is not anticipated, rendered obvious, suggested, or even implied by any of the prior art sign holders and markers, either alone or in any combination thereof.

To attain this, the present invention generally comprises an elongated post with a uniform substantially circular cross-section along a length thereof. As shown in FIG. 3, the post includes a beveled bottom end and a top end. In use, the bottom end serves to be inserted within the ground adjacent to and abutting a tombstone. Next provided is an encasement including a bottom extent having a substantially planar rectangular back plate. This back plate includes a bottom face, a top face and a periphery defined by a top edge, a bottom edge, and a pair of side edges. The bottom face of the back plate is centrally coupled to the top end of the post such that the back plate resides within a plane which forms a 45 degree angle with a horizontal. The bottom extent further includes a peripheral side wall coupled to the periphery of the back plate and extending upwardly therefrom to define an interior space and an outer peripheral edge. As best shown in FIG. 2, the encasement further includes a top extent having a substantially planar rectangular front plate including a bottom face, a top face and a periphery. Such periphery is defined by a top edge, a bottom edge, and a pair of side edges. It should be noted that the periphery of the front plate defines an area greater than that encompassed by the periphery of the back plate of the bottom extent of the encasement. The top extent further includes a peripheral side wall coupled to the periphery of the front plate and extending downwardly therefrom to define an interior space and an outer peripheral edge. FIG. 2 shows the peripheral side wall of the top extent to be hingably coupled to the peripheral side wall of the bottom extent for selectively defining a compartment in the encasement. Mounted on the peripheral side wall of the top extent of the encasement is a lock for engaging the peripheral side wall of the bottom extent. In use, the lock serves for selectively precluding access to the compartment of the encasement. As shown in FIGS. 4 & 5, a gasket is coupled to the outer peripheral edge of the back plate of the encasement for hermetically sealing the compartment of the encasement. Positioned on the top face of the front plate of the front extent of the encasement is indicia that preferably states "In Loving Memory". The encasement is preferably adapted to house photographs therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Furthers the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new memorial stand apparatus and method which has many of the advantages of the sign holders and markers mentioned heretofore and many novel features that result in a new memorial stand which is not anticipated, rendered obvious, suggested, or even implied by any of the prior art sign holders and markers, either alone or in any combination thereof.

It is another object of the present invention to provide a new memorial stand which may be easily and efficiently manufactured and marketed.

It is a further object of the present invention to provide a new memorial stand which is of a durable and reliable construction.

An even further object of the present invention is to provide a new memorial stand which is susceptible of a low cost of manufacture with regard to both materials and labor, and which accordingly is then susceptible of low prices of sale to the consuming public, thereby making such memorial stand economically available to the buying public.

Still yet another object of the present invention-is to provide a new memorial stand which provides in the apparatuses and methods of the prior art some of the advantages thereof, while simultaneously overcoming some of the disadvantages normally associated therewith.

Still another object of the present invention is to provide a new memorial stand for storing and showcasing photographs and memorabilia at a grave.

Even still another object of the present invention is to provide a new memorial stand that includes a post, an encasement mounted on the post with a compartment therein, and a photograph mount situated in the compartment of the encasement for holding a photograph therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
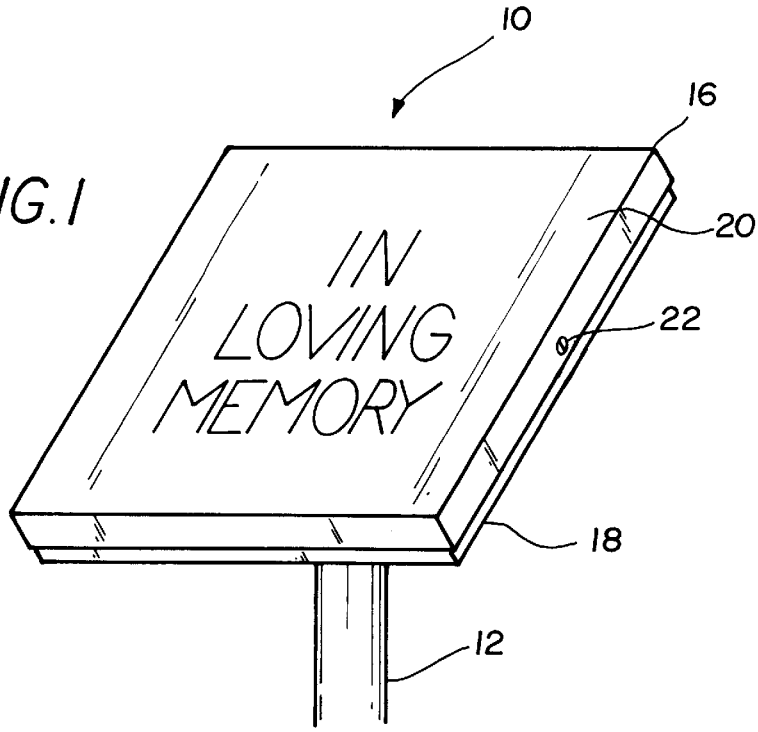
FIG. 1 is a perspective view of a new memorial stand according to the present invention.

With reference now to the drawings, and in particular to FIGS. 1 through 5 thereof, a new memorial stand embodying the principles and concepts of the present invention and generally designated by the reference numeral 10 will be described.

Figure 3:
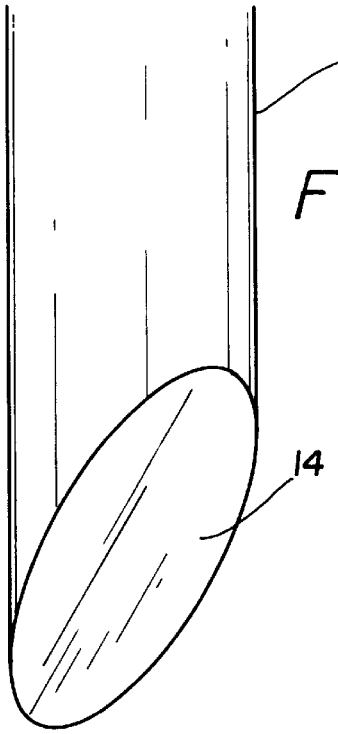
FIG. 3 is a perspective view of the bottom end of the post of the present invention.

The present invention, designated as numeral 10, includes an elongated post 12 with a uniform substantially circular cross-section along a length thereof. As shown in FIG. 3, the post includes a beveled bottom end 14 and a top end. In use, the bottom end serves to be inserted within the ground adjacent to and abutting a tombstone. By the specific configuration and positioning of the post, mowing around the tombstone is facilitated. As an option, an enlarged concrete base may be mounted on the bottom end of the post for further securing the post within the ground.

Next provided is an encasement 16 including a bottom extent 18 having a substantially planar rectangular back plate. This back plate includes a bottom face, a top face and a periphery defined by a top edge, a bottom edge, and a pair of side edges. The bottom face of the back plate is centrally coupled to the top end of the post such that the back plate resides within a plane which forms about a 45 degree angle with a horizontal. The bottom extent further includes a peripheral side wall coupled to the periphery of the back plate and extending upwardly therefrom to define an interior space and an outer peripheral edge. While not shown, a brace is preferably coupled between a central extent of the post and the bottom face of the bottom plate adjacent to the bottom edge thereof.

Figure 2:
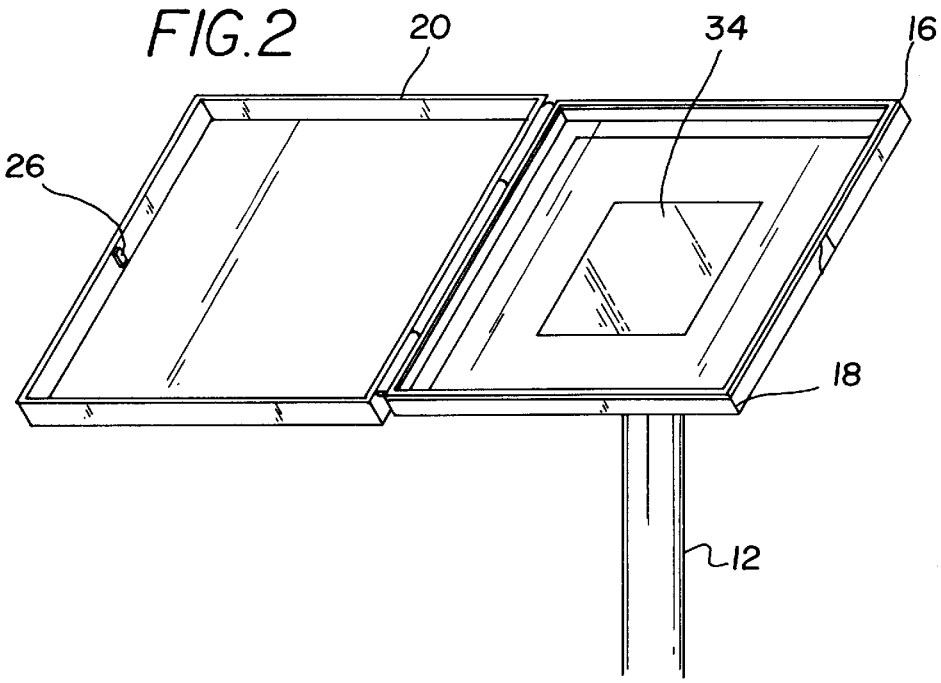
FIG. 2 is a perspective view of the present invention in an open orientation.
Figure 5:
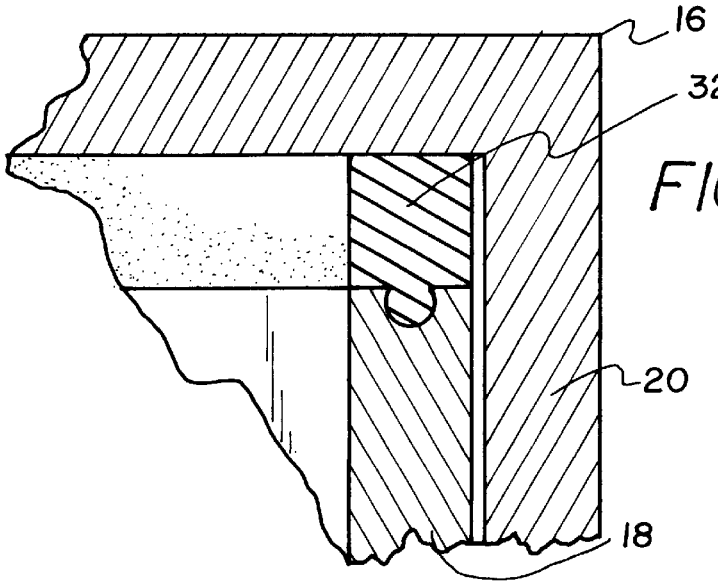
FIG. 5 is a side cross-sectional view of the gasket of the present invention.

As best shown in FIG. 2, the encasement further includes a top extent 20 having a substantially planar rectangular front plate including a bottom face, a top face and a periphery. Such periphery is defined by a top edge, a bottom edge, and a pair of side edges. It should be noted that the periphery of the front plate defines an area greater than that encompassed by the periphery of the back plate of the bottom extent of the encasement. The top extent further includes a peripheral side wall coupled to the periphery of the front plate and extending downwardly therefrom to define an interior space and an outer peripheral edge. FIG. 2 shows the peripheral side wall of the top extent to be hingably coupled to the peripheral side wall of the bottom extent for selectively defining a compartment in the encasement. As shown in FIG. 5, the peripheral side wall of the top extent overlaps that of the bottom extent when in a closed orientation.

Mounted on the peripheral side wall of the top extent of the encasement is a lock 22 for engaging the peripheral side wall of the bottom extent. The lock preferably includes a key-receiving mechanism 24 which allows selective rotation of an associated arm 26. This arm may be selectively inserted within a slot 28 and rotated to engage a recess 30 formed in the bottom extent. In use, the lock serves for selectively precluding access to the compartment of the encasement.

Figure 4:
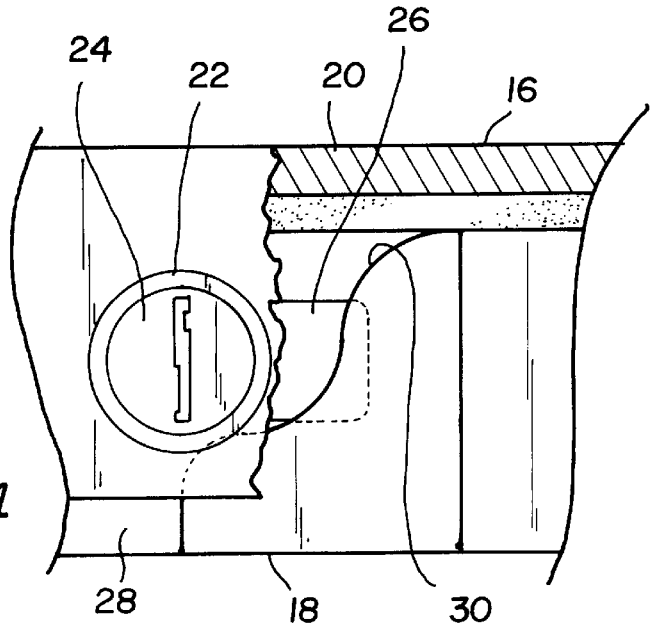
FIG. 4 is an illustration of the lock of the present invention.

As shown in FIGS. 4 & 5, a gasket 32 is coupled to the outer peripheral edge of the back plate of the encasement for hermetically sealing the compartment of the encasement. Positioned on the top face of the front plate of the front extent of the encasement is indicia that preferably states "In Loving Memory".

Finally, a photo housing 34 is provided including a transparent sheet mounted on the front face of the back plate of the bottom extent of the encasement for housing a photograph. As an option, the photo housing may include a plurality of resilient semi-rigid sheets each with a transparent front layer. The sheets are each hingably mounted directly to the front face of the back plate of the bottom extent of the encasement. Either a top edge or a side edge of the front layer may be open for receiving photographs therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A memorial assembly comprising, in combination:

an elongated post with a uniform substantially circular cross-section along a length thereof, the post including a beveled bottom end and a top end, the bottom end adapted to be inserted within the ground adjacent to and abutting a tombstone;

an encasement including a bottom extent having a substantially planar rectangular back plate including a bottom face, a top face and a periphery defined by a top edge, a bottom edge, and a pair of side edges, the bottom face of the back plate being centrally coupled to the top end of the post such that the back plate resides within a plane which forms a 45 degree angle with a horizontal, the bottom extent further including a peripheral side wall coupled to the periphery of the back plate and extending upwardly therefrom to define an interior space and an outer peripheral edge, the encasement further including a top extent having a substantially planar rectangular front plate including a bottom face, a top face and a periphery defined by a top edge, a bottom edge, and a pair of side edges, wherein the periphery of the front plate defines an area greater than that encompassed by the periphery of the back plate of the bottom extent of the encasement, the top extent further including a peripheral side wall coupled to the periphery of the front plate and extending downwardly therefrom to define an interior space and an outer peripheral edge which is hingably coupled to the peripheral side wall of the bottom extent for selectively defining a compartment in the encasement;

a lock mounted on the peripheral side wall of the top extent of the encasement for engaging the peripheral side wall of the bottom extent for selectively precluding access to the compartment of the encasement;

a gasket coupled to the outer peripheral edge of the back plate of the encasement for hermetically sealing the compartment of the encasement;

indicia positioned on the top face of the front plate of the front extent of the encasement; and a photo housing including a transparent sheet mounted on the front face of the back plate of the bottom extent of the encasement for housing a photograph.

2. A memorial assembly comprising:

an elongated post with a length, the post including a beveled bottom end, the bottom beveled end adapted to be inserted into a ground surface adjacent to a tombstone;

an encasement including a bottom extent having a back plate including a bottom face, a top face and a periphery defined by a top edge, a bottom edge, and a pair of side edges, the bottom face of the back plate being centrally coupled to the top end of the post, the bottom extent further including a peripheral side wall coupled to the periphery of the back plate and extending upwardly therefrom to define an interior space and an outer peripheral edge, the encasement further including a top extent having a front plate including a bottom face, a top face and a periphery defined by a top edge, a bottom edge, and a pair of side edges, wherein the periphery of the front plate defines an area greater than that encompassed by the periphery of the back plate of the bottom extent of the encasement, the top extent further including a peripheral side wall coupled to the periphery of the front plate and extending downwardly therefrom to define an interior space and an outer peripheral edge which is hingably coupled to the peripheral side wall of the bottom extent for selectively defining a compartment in the encasement;

a lock mounted on the peripheral side wall of the top extent of the encasement for engaging the peripheral side wall of the bottom extent for selectively precluding access to the compartment of the encasement, the lock being mounted horizontally on the peripheral side wall of the top extent such that debris and water are prevented from entering and damaging the lock; and a gasket coupled to the outer peripheral edge of one of the plates of the encasement for hermetically sealing the compartment of the encasement;

a photo housing including a transparent sheet mounted on the front face of the back plate of the bottom extent of the encasement for housing a photograph.

3. The memorial assembly of claim 2, wherein indicia are positioned on the top face of the front plate of the front extent of the encasement.

4. The memorial assembly of claim 2, wherein the back plate resides within a plane which forms a 45 degree angle with a horizontal.

* * * * *